United States Patent [19]

Menge

[11] Patent Number: 4,925,004

[45] Date of Patent: May 15, 1990

[54] APPARATUS FOR CHANGING THE DIRECTION OF TRANSPORT OF ROD-SHAPED ARTICLES

[75] Inventor: Günter Menge, Hamburg, Fed. Rep. of Germany

[73] Assignee: Körber AG, Hamburg, Fed. Rep. of Germany

[21] Appl. No.: 681,119

[22] Filed: Dec. 13, 1984

[30] Foreign Application Priority Data

Dec. 21, 1983 [DE] Fed. Rep. of Germany ..... 3346143

[51] Int. Cl.[5] ..... B65G 47/26

[52] U.S. Cl. ..... 198/457; 198/689.1

[58] Field of Search ..... 198/457, 689, 461, 689.1

[56] References Cited

U.S. PATENT DOCUMENTS

| | | | |
|---|---|---|---|
| 2,010,486 | 8/1935 | Hermann | 198/457 |
| 2,142,271 | 1/1939 | Herrmann | 198/461 X |
| 3,153,472 | 10/1964 | Mason | 198/457 X |
| 3,365,046 | 1/1968 | Morris et al. | 198/457 X |
| 4,189,045 | 2/1980 | Verjux | 198/457 |

FOREIGN PATENT DOCUMENTS

| | | | |
|---|---|---|---|
| 89674 | 7/1937 | Sweden | 198/457 |

*Primary Examiner*—Robert J. Spar
*Assistant Examiner*—Cheryl L. Gastineau
*Attorney, Agent, or Firm*—Peter K. Kontler

[57] ABSTRACT

Apparatus for converting a file of coaxial filter rod sections into one or more rows of such sections has two identical disc cams adjacent to the path of successive foremost sections of the file and being driven in synchronism so that their lobes simultaneously shift the adjacent foremost section sideways along a smooth supporting surface and thereby accelerate such section to the speed of sections in the row or rows while the section continues to move axially toward the oncoming flute of a drum-shaped conveyor which forms and advances the rows of sections into a filter tipping machine. The lobes and the adjacent portions of the peripheral surfaces of the disc cams are formed with suction ports which attract the foremost sections of the file during lateral shifting to thus ensure highly predictable and gentle changes in the direction of travel of successive foremost sections on their way into the respective flutes of the drum-shaped conveyor. The supporting surface is tangential to the circumference of the conveyor.

16 Claims, 2 Drawing Sheets

FIG. 2
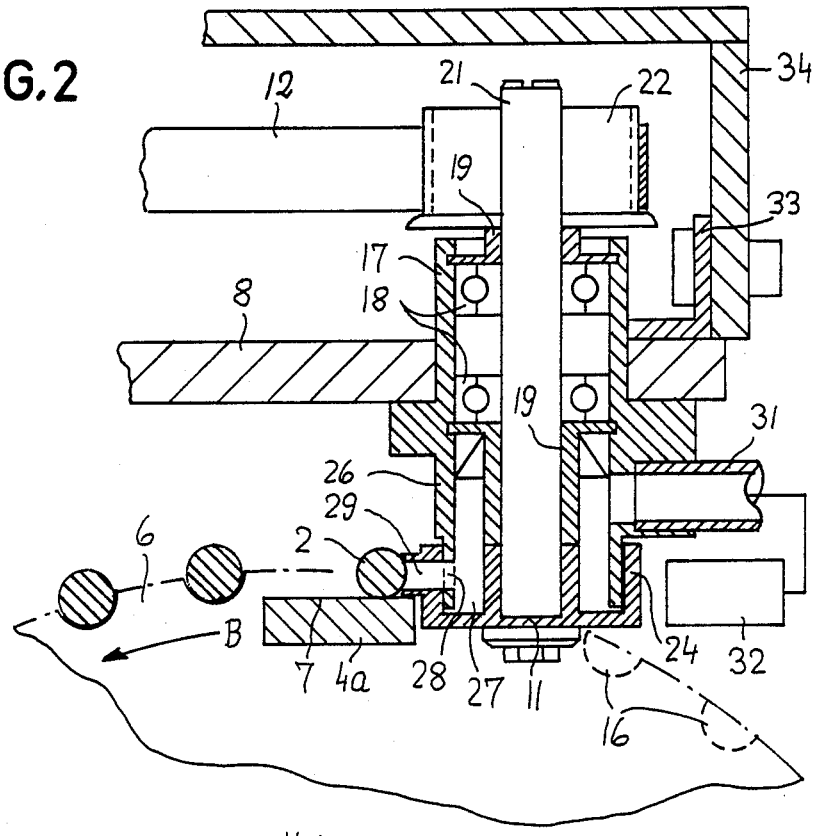
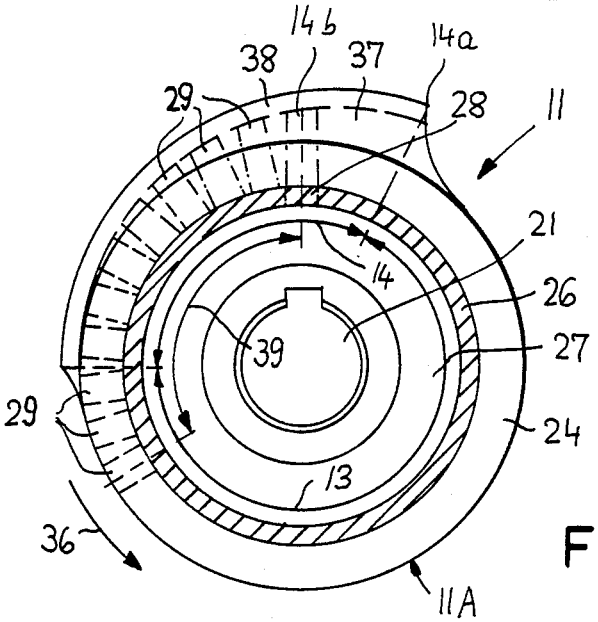
FIG. 3

APPARATUS FOR CHANGING THE DIRECTION OF TRANSPORT OF ROD-SHAPED ARTICLES

BACKGROUND OF THE INVENTION

The present invention relates to improvements in apparatus for manipulating rod-shaped articles, especially rod-shaped articles of the tobacco processing industry. More particularly, the invention relates to improvements in apparatus for changing the direction of transport of rod-shaped articles including plain or filter tipped cigarettes, cigars or cigarillos, filter rod sections and others. Still more particularly, the invention relates to improvements in apparatus for changing the direction of transport of articles which move axially so that the articles thereupon move sideways, i.e., at right angles to the respective axes.

A rod-making machine, such as a filter rod making machine, turns out a continuous rod wherein a rod-shaped filler of fibrous material is surrounded by a tubular wrapper consisting of cigarette paper, imitation cork or other suitable wrapping material. The leader of the rod is severed at regular intervals by the knife or knives of a suitable cutoff so that the severed articles form a single file of articles of unit length or multiple unit length. In order to further process such rod-shaped articles, it is often necessary to convert the single file into one or more rows wherein the articles are parallel to and are disposed one after the other, i.e., wherein the articles advance at right angles to their respective axes.

The conversion of a single file of coaxial rod-shaped articles, such as filter rod sections, cigarettes, cigars or cigarillos, into one or more rows presents serious problems in modern high-speed rod making machines which are designed to turn out large or extremely large quantities of rod-shaped articles per unit of time. The main problem is that the intervals of time which are available for effecting a change in the direction of movement of successive articles from axial movement in a file to sidewise movement in a row are extremely short (in the range of a few milliseconds) and the articles which have been caused to change the direction of their movement must be properly introduced into the receptacles (e.g., peripheral flutes) of a conveyor (such as a rapidly rotating drum) which serves to transport one or more rows of articles sideways. Improper operation of the direction changing mechanism or mechanisms can cause interruptions in the delivery of rod-shaped articles to the next processing machine (e.g., a filter tipping machine) and can also entail deformation of or even much more serious damage to (including total destruction of) the articles.

In order to facilitate the introduction of successive rod-shaped articles of a file of coaxial articles into successive peripheral flutes of a rotary drum-shaped conveyor, it is already known to accelerate successive articles by a rapidly rotating accelerating cam whose lobe or lobes engage and propel successive articles in a direction toward and into the oncoming flutes. Such cams are satisfactory as long as their peripheral speed is not very high; however, once the peripheral speed exceeds a certain value, the force with which the rapidly orbiting lobe or lobes strike relatively small portions of the wrappers of successive rod-shaped cigarettes, filter rod sections or like rod-shaped articles of the tobacco processing industry is so pronounced that the wrappers are scored or undergo other types of deformation or damage which renders them useless for further processing.

It is to be borne in mind that a filter tipping machine must receive filter rod sections at a rate such that it can process the output of a cigarette maker which turns out up to and even in excess of 8000 plain cigarettes per minute.

It was further proposed to change the direction of movement of successive rod-shaped articles of a file of axially moving articles before the articles begin to enter the axially parallel flutes at the periphery of a rapidly rotating drum-shaped conveyor. In other words, each article of a file of such articles receives a component of movement in the circumferential direction of the drum even before the leaders of such articles enter the oncoming flutes. For example, German Pat. No. 1,228,978 discloses an apparatus wherein the discharge end of the conveyor which transports a single file of rod-shaped articles is adjacent to a driven wheel whose axis is slightly inclined with reference to the axes of the oncoming articles of the file and which has a helical peripheral flute serving to impart to successive articles a component of movement at right angles to the longitudinal directions of the peripheral flutes of the drum-shaped conveyor whereon the single file of articles (namely cigarettes) is converted into one or more rows. The surface bounding the helical groove in the peripheral surface of the wheel is formed with suction ports which are connected to a suction generating device so that the wheel attracts the articles which reach the discharge end of the conveyor for the single file of such articles. The peripheral speed of the wheel is selected in such a way that successive articles of the file are accelerated in the axial direction as well as in the circumferential direction of the fluted drum. A drawback of the patented apparatus is that the wheel attracts only very short portions of the wrappers of successive cigarettes, and more particularly very short portions of the wrappers at the leading ends of successive articles. Therefore, the change in the direction of transport of successive cigarettes is so abrupt that the articles change their orientation and cannot readily enter the oncoming flutes. Such apparatus might be satisfactory when the cigarettes of the single file are delivered at a relatively low speed but it is incapable of properly introducing successive cigarettes or like rod-shaped articles of the tobacco processing industry into successive flutes of a rotating drum as soon as the speed of the drum exceeds a certain value which is well below that required in a modern filter tipping or like machine. It has been found that, when the speed of axial movement of the cigarettes which form the single file is relatively high, the wheel with its helical groove and suction ports in the surface bounding the helical groove cannot adequately control the movements of the cigarettes and also that the cigarettes are subjected to excessive and hence totally unacceptable bending and buckling stresses. Therefore, the patented apparatus is not suited for the transfer of, for example, filter rod sections into successive flutes of a rotating drum in a modern filter tipping machine.

German Offenlegungsschrift No. 27 49 225 discloses a modified apparatus wherein successive rod-shaped articles of the single file are also caused to change the direction of their movement even before they enter the peripheral flutes of a rotary drum-shaped conveyor for one or more rows of such rod-shaped articles. This German printed publication discloses a foraminous belt conveyor one side of which is adjacent to a suction chamber and the other side of which transports successive articles of the single file into the range of two discs each of which has a lobe with an arcuate article-engaging surface of gradually increasing radius. The conveyor accelerates the articles of the file axially and the lobes of the two discs push the oncoming articles sideways so that the articles are shifted along the foraminous conveyor in the circumferential direction of the row-forming drum. The speeds of the discs and the configurations of their lobes are selected in such a way that successive articles of the file are accelerated to the peripheral speed of the drum before their leaders enter the oncoming axially parallel peripheral flutes of the drum. It has been found that the just described prior apparatus treats the articles rather gently, when compared with the treatment by the aforementioned wheel with its helical groove, but that the mechanical stressing of the articles is still excessive when the articles are to be fed into a modern filter tipping machine or the like. This is due to the fact that, on the one hand, the articles are caused to adhere to the foraminous conveyor opposite to the suction chamber and, on the other hand, the lobes of the discs cause the articles to move along the conveyor sideways and to rapidly acquire a component of movement in the peripheral direction of the drum so that their speed in such peripheral direction matches the peripheral speed of the drum at the instant of entry of their leaders into the oncoming axially parallel flutes. In addition, the apparatus must employ discrete drive means for the foraminous conveyor and for the discs. This contributes to the bulk, initial cost, maintenance cost and proneness to malfunction of such apparatus.

OBJECTS AND SUMMARY OF THE INVENTION

An object of the invention is to provide a novel and improved apparatus which can convert a file of coaxial rod-shaped articles of the tobacco processing industry into one or more rows of parallel articles in such a way that each and every article is gently but positively and predictably guided during transfer from the first path wherein the article moves axially into the second path wherein the article advances sideways, i.e., at right angles to its axis.

Another object of the invention is to provide the apparatus with novel and improved means for transferring successive articles of a file of coaxial articles into successive flutes of a drum-shaped conveyor.

A further object of the invention is to provide an apparatus which subjects the articles to acceptable mechanical stresses during a change in the direction of transport irrespective of the speed at which the articles of the file advance toward the transfer station.

An additional object of the invention is to provide an apparatus which is relatively simple, compact and inexpensive but much more reliable and more versatile than heretofore known apparatus.

Still another object of the invention is to provide a novel and improved method of preventing stray movements of successive foremost articles of a rapidly moving file of coaxial articles during transfer of such articles onto a conveyor which moves the articles sideways.

A further object of the invention is to provide an apparatus wherein the articles can be accelerated to the speed of the aforementioned conveyor even before they reach the conveyor and wherein such acceleration can be carried out without adversely affecting the appearance and/or other desirable characteristics of the articles.

Another object of the invention is to provide a machine which is utilized for the production and/or processing of rod-shaped articles of the tobacco processing industry and embodies the above outlined apparatus.

The invention is embodied in an apparatus for manipulating rod-shaped articles of the tobacco processing industry, such as plain cigarettes of unit length or multiple unit length or filter rod sections of multiple unit length. The apparatus comprises means (e.g., including the upper reach of an endless belt conveyor) for moving a file of rod-shaped articles in a first direction axially along a first path (e.g., along a substantially horizontal path), means for advancing successive articles of the file along a second path and in a second direction at least substantially at right angles to the first direction, and first and second hollow transfer members (e.g., two identical disc cams) adjacent to the first path, rotatable about parallel axes and disposed one after the other, as considered in the first direction. The transfer members have specially configurated peripheral surfaces each including at least one first section with a smaller first radius and at least one second section with a gradually increasing second radius. Each transfer member includes a foraminous wall defining at least a predetermined portion of the respective peripheral surface, and the apparatus further comprises drive means for rotating the transfer members as well as means for establishing a pressure differential at the opposite sides of the foraminous walls so that the predetermined portions of the respective peripheral surfaces attract the adjacent articles to the corresponding transfer members. The foraminous walls are preferably formed with substantially radially extending ports, and the pressure differential establishing means preferably includes suction generating means which serves to draw air through the ports and into the interior of the transfer members. Valve means is preferably provided for connecting the suction generating means with those ports which are adjacent to portions of articles in the first path, i.e., with those ports which are capable of attracting the articles to the respective transfer members.

The predetermined portion of each of the peripheral surfaces preferably includes at least a portion of the respective second section and/or at least a portion of the respective first section. The second section of each peripheral surface has a portion of maximum diameter, and the predetermined portion of each peripheral surface preferably terminates at a location which is remote from the maximum-diameter portion of the respective second section.

The drive means preferably comprises means for rotating the two transfer members in synchronism so that the second sections of the two peripheral surfaces simultaneously engage longitudinally spaced-apart portions of successive foremost articles in the first path while such articles continue to move in the first direction. The orientation of the second section of the peripheral surface of the first transfer member is preferably identical with the orientation of the second section of the peripheral surface of the second transfer member in all angular positions of the two transfer members.

The moving means can comprise a plate- or table-like member having a smooth surface which is adjacent to the transfer members and along which successive foremost articles of the file move in the second direction in response to engagement by the second sections of the two peripheral surfaces. The advancing means can comprise a substantially drum-shaped conveyor having axially parallel peripheral flutes for the articles in the second path, and the aforementioned smooth surface is preferably at least substantially tangential to the circumference of the drum, and more particularly to the cylinder which is defined by the deepmost portions of the flutes of such drum. The transfer members are preferably disposed above and close to the smooth surface of the plate- or table-like member, and the axes of the two transfer members are preferably normal to such smooth surface.

The first sections of the peripheral surfaces of the two transfer members are preferably immediately adjacent to the first path in the region where the first path ends, and the second sections of the two peripheral surfaces preferably extend progressively deeper into the first path during each revolution of the transfer members to thereby shift successive foremost articles of the file along the smooth surface of the plate- or table-like member and in the second direction to thus facilitate entry of the leaders of successive foremost articles into successive flutes of the advancing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a fragmentary vertical sectional view as seen in the direction of arrows from the line II—II of FIG. 1; and FIG. 3 is an enlarged horizontal sectional view of one of the transfer members.

DESCRIPTION OF THE PREFERRED EMBODIMENTS

Figure 1:
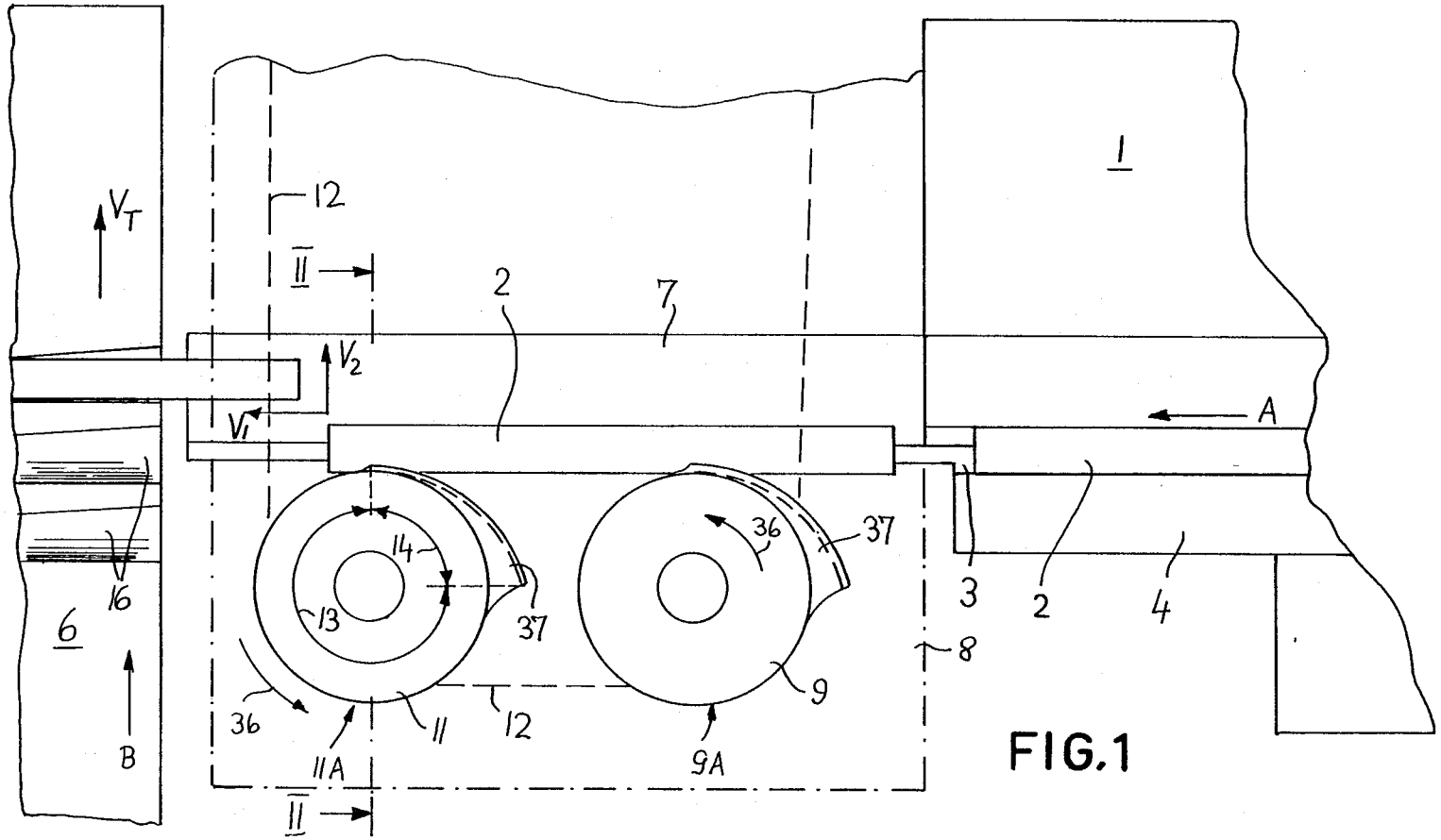
FIG. 1 is a fragmentary schematic plan view of an apparatus which is installed between a filter rod making machine and a filter tipping machine and embodies one form of the invention.

FIG. 1 shows a portion of a filter rod making machine 1, e.g., a machine known as KDF which is manufactured and distributed by the assignee of the present application. Reference may be had, for example, to commonly owned U.S. Pat. No. 4,046,064 granted Sept. 6, 1977 to Günter Wahle which discloses a suitable filter rod making machine. Such machine comprises means (e.g., the endless belt conveyor 39 ; shown in the aforementioned patent) for moving a single file of rod-shaped articles 2 (e.g., filter rod sections of multiple-unit length) along a horizontal path and in the direction of arrow A. Such path is defined in part by an elongated horizontal rail 4 having a prismatic groove 3 and being located downstream of a cutoff which subdivides a continuous filter rod into the aforementioned single file of coaxial articles 2. The means for advancing successive foremost articles 2 of the file along a second path and in a direction (arrow B) which is at least substantially normal to the first direction (arrow A) comprises an endless drum-shaped conveyor 6 having axially parallel peripheral flutes 16 each of which can receive a single article or a plurality of articles, depending upon whether the single file which is delivered by the groove 3 of the rail 4 is to be converted into one or more rows of parallel articles. The conveyor 6 can form part of a filter tipping machine, e.g., a machine known as MAX S which is manufactured and sold by the assignee of the present application. A suitable filter tipping machine is described and shown in commonly owned U.S. Pat. No. 4,262,680 granted Apr. 21 1980 to Alfred Hinzmann.

The foremost portion of the rail 4 constitutes a horizontal plate- or table-like support **4*a* having a smooth top surface 7 which is tangential or substantially tangential to the circumference of the drum-shaped conveyor 6, namely to the cylinder which is formed by the deepmost portions of the equidistant axially parallel peripheral flutes 16 of the conveyor 6**.

The surface 7 of the support **4*a* is adjacent to a plate-like holder 8 for two identical transfer members 9 and 11 each of which constitutes or resembles a disc cam having a specially configurated peripheral surface 9A, 11A, respectively. The transfer members 9 and 11 (hereinafter called discs for short) are adjacent to one side of the path of movement of successive foremost articles 2 of the single file of such articles toward the conveyor 6 and are located opposite the smooth surface 7 of the support 4*a*. The drive means for rotating the discs 9 and 11 in synchronism with one another about parallel axes which are preferably normal to the surface 7 includes an endless toothed belt 12 (see also FIG. 2) which is trained over toothed pulleys 22 at the upper ends of the shafts 21 of the respective discs and receives motion from the main prime mover of the filter rod making machine 1 (or of the production line including the machine 1 and the filter tipping machine) so as to ensure that the peripheral speed of the discs 9 and 11 is invariably proportional to the speed of axial movement of the articles 2 in the groove 3 of the rail 4**.

The peripheral surfaces 9A, 11A of the discs 9 and 11 respectively comprise first arcuate sections 13 having constant radii and second arcuate sections 14 having gradually increasing radii and following the respective sections 13, as considered in the direction of arrows 36 shown in FIGS. 1 and 3 and denoting the direction of rotation of the two discs. The minimum radius of each section 14 matches the radius of the respective section 13, and the maximum radius (at **14*a*) of each section 14 is located at the rearmost end of such section, as considered in the direction of rotation of the respective disc. As can be seen in FIG. 3, the sections 14 can extend along arcs of slightly more than 90 degrees. The sections 13 of the peripheral surfaces 9A and 11A are immediately adjacent to but do not actually extend into the (first) path of movement of successive foremost articles 2 of the single file along the smooth surface 7 of the support 4*a* in the direction of arrow A. However, the second sections 14 of the peripheral surfaces 9A and 11A extend progressively deeper into the first path during each revolution of the respective discs and thus cause the adjacent foremost articles 2 to move on the surface 7** sideways, namely in the direction which is indicated by the arrow B.

The surface 7 of the support **4*a* need not attract the articles by suction or otherwise because the improved apparatus further comprises novel and improved means for ensuring that successive foremost articles 2 of the file of such articles in the machine 1 are attracted to the adjacent portions 39 of the peripheral surfaces 9A and 11A so that each and every article 2 follows one and the same course during transfer from the surface 7 into the corresponding (oncoming) flute 16 of the conveyor 6**. Such ensuring means includes means for establishment a pressure differential at the opposite sides of that foraminous wall (24) of each disc which defines the respective peripheral surface 9A, 11A, and the pressure differential establishing means comprises a suitable suction generating device 32 (see FIG. 2) and suction ports 29 extending radially of the wall 24 and being machined into the portion 39 of the respective peripheral surface.

Referring now to FIG. 2 in greater detail, the holder 8 is secured to a frame member (not shown) of the filter rod making machine 1 and supports an upright sleeve-like casing 17 for each of the discs 9 and 11. The illustrated casing 17 confines two anti-friction ball bearings 18 and two plain bearings 19 for the shaft 21 whose upper end portion is keyed to the respective toothed pulley 22 and whose lower end portion carries the respective foraminous wall 24. The latter forms part of a substantially cup-shaped body which sealingly surrounds a valving element 26 constituting the lower end portion of the respective casing 17 and serving as a means for controlling the flow of air from the suction ports 29 to the suction generating device 32. The apparatus can comprise a discrete suction generating device 32 for each of the discs 9, 11 or a common suction generating device for both discs. The parts 24 and 26 of FIG. 2 surround an annular suction chamber 27 which communicates with the suction generating device 32 by way of a nipple 31 on the casing 17 and which communicates with selected ports 29, namely with those ports whose inner ends are not sealed by the lower end portion or valving element 26 of the casing 17. The valving element 26 has a slot 28 which permits the adjacent port or ports 29 of the wall 24 to communicate with the suction chamber 27 so that each port which communicates with the slot 28 can attract the adjacent portion of the foremost article 2 which slides along the surface 7 and is on its way toward the conveyor 6. FIG. 2 further clearly shows that the surface 7 of the support 4*a* is substantially tangential to the cylinder which is defined by the deepmost portions of the flutes 16 in the peripheral surface of the drum-shaped conveyor 6.

The holder 8 further carries a bracket 33 for a protective hood 34 which overlies the pulleys 22 for the shafts 21 of the discs 9 and 11.

FIG. 3 shows that the width of the slot 28 in the valving element 26 (as considered in the circumferential direction of the respective wall 24) need not exceed the diameter of a port 29, i.e., the arrangement may be such that only a single port 29 of the wall 24 can communicate with the suction chamber 27 at any given time. The slot 28 faces the foremost portion of the first path along which successive articles 2 of the single file advance toward and along the surface 7. The wall 24 is keyed to the lower end portion of the respective shaft 21 (see FIG. 3). That portion of the wall 24 which includes the second section 14 of the peripheral surface 11A of the disc 11 shown in FIG. 3 constitutes a lobe 37 whose radius increases gradually in the aforementioned manner, i.e., from the adjacent end of the section 13 to the portion 14*a* where the radius of the lobe 37 assumes a maximum value. The section 14 of the peripheral surface 11A is preferably formed with an arcuate groove 38 bounded by a concave surface whose radius of curvature may but need not approximate or match the radius of an article 2.

As mentioned above, the disc 11 is identical with the disc 9 and the orientation of both arcuate second sections 14 in all angular positions of the two discs is the same. Thus, the operation of the drive means for the disc 9 is synchronized with that of the drive means for the disc 11 in such a way that the lobes 37 of the two discs simultaneously engage two spaced-apart portions of the external surface of the foremost article 2 of the file (namely, of the article on the surface 7) and begin to gradually shift the article sideways (arrow B) while the article continues to advance in the direction of arrow A. FIG. 1 shows the discs 9 and 11 in those angular positions in which their lobes 37 are about to start the shifting operation upon the adjacent article 2 on the smooth surface 7. As the discs 9 and 11 continue to rotate in the directions indicated by the arrows 36, their lobes 37 gradually shift the article 2 upwardly, as viewed in FIG. 1, so that the article acquires a component $V_2$ of velocity in the direction of arrow B while retaining its component $V_1$ of velocity in the direction of arrow A. The component $V_2$ matches the velocity $V_T$ of the flutes 16 in the conveyor 6 when the article 2 on the surface 7 is engaged by the radially outermost portions of the lobes 37 on the discs 9 and 11. The component $V_2$ grows gradually, while the component $V_1$ remains at least substantially unchanged, until it reaches or rather closely approximates the value $V_T$. The timing of acceleration of the article to the velocity $V_2$ (which equals or approximates $V_T$) is such that the acceleration is completed when the leader of the foremost axially advancing article 2 (on the surface 7) reaches the adjacent end of the oncoming flute 16 in the peripheral surface of the continuously rotating conveyor 6. Thus, the article 2 enters the oncoming flute 16 without being subjected to any bending, flexing, buckling or other deforming stresses. The operation is highly satisfactory irrespective of the selected speed of articles along the guide 4 and the surface 7, and the entry of articles 2 into the flutes 16 takes place smoothly and gently so that neither the appearance nor other desirable characteristics of the articles are adversely influenced during transfer from the surface 7 onto the conveyor 6.

The articles 2 are reliably held and guided during the critical stage of acceleration to the velocity $V_2$ in the direction of arrow B because, at such time, the articles are attracted to the portion 39 of the peripheral surface of each of the two discs 9 and 11 due to the fact that successive ports 29 then communicate with the corresponding slots 28 and hence with the respective suction chambers 27 in the interior of the hollow discs. As shown in FIG. 3, some of the suction ports 29 are provided in the downstream part of the section 13 so that the discs 9 and 11 can begin to attract successive foremost articles 2 of the file in the machine 1 even before such articles begin to undergo an acceleration in the direction of arrow B. The feature that the suction ports 29 terminate short of those portions of the lobes 37 where the radii of the respective sections 14 assume their maximum values (at 14*a*) is desirable and advantageous in many instances because this ensures that the wrappers of the articles 2 are not attracted to the corresponding sections 14 during the last stage of their acceleration to the velocity $V_2$, i.e., suction in the interior of the discs 9 and 11 cannot interfere with the introduction of successive articles 2 into the oncoming flutes 16. The radially outermost portions of the lobes 37 continue to shift the articles 2 sideways (arrow B) while the leaders of such articles are in the process of entering the oncoming flutes 16 to thus even more reliably hold the articles in proper orientation for convenient and deformation-free penetration into the respective flutes 16.

Each of the discs 9 and 11 can be provided with several sections 13 and 14 if the diameters of the discs are large and the articles 2 are relatively short so that each of the discs completes only a fraction of a full revolution during introduction of an article into the oncoming flute 16 of the conveyor 6. The provision of several discs ensures that each foremost article 2 is engaged by several lobes and is even more predictably shifted in the direction of arrow B before it begins to penetrate into the oncoming flute 16. The rate at which the radii of the arcuate sections 14 increase can be selected with a view to ensure soft and gradual acceleration of successive articles to the velocity $V_2$. The orientation of the articles remains unchanged during each stage of acceleration to the velocity $V_2$ because each of the articles is simultaneously engaged and shifted as well as attracted by several discs.

Since the surface 7 of the support 4*a* is smooth, it offers little resistance to movements of the articles 2 in the directions of arrows A and B so that the external surfaces of the articles are not in pronounced frictional engagement with the rail 4 during axial movement in the direction of arrow A (velocity $V_1$) and simultaneous progressive acceleration in the direction of arrow B. Thus, mechanical stressing of successive articles 2 which slide along the surface 7 is negligible or minimal and does not result in any damage to the conveyed articles. The placing of two relatively small and identically configurated and dimensioned discs close to the end of the first path for the articles contributes to compactness and lower cost of the improved apparatus.

The apparatus can be modified in such a way that, if the conveyor 6 is driven counter to the direction which is indicated by the arrow B, those sections of peripheral surfaces of the two discs whose radii vary pull the articles 2 downwardly, as viewed in FIG. 1, but with the same result (i.e., the leaders of successive articles 2 enter the oncoming flutes 16 of the conveyor 6 while moving in the direction of arrow A and while moving counter to the direction which is indicated by the arrow B at a speed which matches or at least approximates the speed $V_T$ of the flutes).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating rod-shaped articles of the tobacco processing industry, comprising means for moving a file of rod-shaped articles in a first direction axially along a first path; means for advancing successive articles of the file along a second path and in a second direction at least substantially at right angles to said first direction; first and second hollow transfer members adjacent to said first path, rotatable about parallel axes and disposed one after the other, as considered in said first direction; said members having peripheral surfaces each including at least one first section of a smaller first radius and at least one second section of a gradually increasing second radius, at least said second sections being arranged to impart to oncoming articles a component of movement in said second direction, each of said transfer members including a foraminous wall defining a predetermining portion of the respective peripheral surface; drive means for rotating said transfer members in the same direction; and means for establishing a pressure differential at the opposite sides of said foraminous walls so that said predetermined portions of the respective peripheral surfaces attract the adjacent articles to the corresponding transfer members.

2. The apparatus of claim 1, wherein said foraminous walls have ports extending substantially radially of the respective transfer members

3. The apparatus of claim 2, wherein said pressure differential establishing means comprises suction generating means arranged to draw air through said ports and into the interior of said transfer members.

4. The apparatus of claim 1, wherein said predetermined portion of each of said peripheral surfaces includes at least a portion of the respective second section

5. The apparatus of claim 1, wherein said walls have substantially radially extending ports and said pressure differential establishing means includes suction generating means and valve means for connecting said suction generating means with those ports which are adjacent to portions of the foremost article in said first path.

6. The apparatus of claim 1, wherein said drive means comprises means for rotating said transfer members in synchronism so that the second sections of said peripheral surfaces simultaneously engage longitudinally spaced-apart portions of successive foremost articles in said first path while such articles continue to move in said first direction.

7. The apparatus of claim 6, wherein the orientation of the second section of the peripheral surface of said first transfer member is identical with the orientation of the second section of the peripheral surface of said second transfer member in all angular positions of said transfer members.

8. The apparatus of claim 1, wherein said predetermined portion of each of said peripheral surfaces includes a part of the respective first section and a part of the respective second section.

9. The apparatus of claim 8, wherein the second section of each of said peripheral surfaces has a portion of maximum diameter and each of said predetermined portions terminates at a location which is remote from the maximum-diameter portion of the respective second section.

10. The apparatus of claim 1, wherein said moving means has a smooth surface which is adjacent to said transfer members and along which successive foremost articles of the file move in said second direction in response to engagement by the second sections of said peripheral surfaces.

11. The apparatus of claim 10, wherein said advancing means comprises a substantially drum-shaped conveyor and said smooth surface is disposed substantially tangentially of the circumference of said conveyor.

12. The apparatus of claim 10, wherein said transfer members are disposed at a level above said smooth surface.

13. The apparatus of claim 12, wherein the axes of said transfer members are at least substantially normal to said smooth surface.

14. The apparatus of claim 12, wherein the first sections of the peripheral surfaces of said transfer members are immediately adjacent to said first path.

15. The apparatus of claim 12, wherein the second sections of said peripheral surfaces extend progressively deeper into said first path during each revolution of said transfer members to thereby shift the adjacent successive foremost articles of the file in said second direction.

16. Apparatus for manipulating rod-shaped articles of the tobacco processing industry, such as filter rod sections of multiple unit length, comprising means for moving a file of rod-shaped articles in a first direction axially along a first path; means for advancing successive articles of the file along a second path and in a second direction at least substantially at right angles to said first direction; first and second hollow transfer members adjacent to said first path, rotatable about parallel axes and disposed one after the other, as considered in said first direction, said transfer members having identical peripheral surface each including at least one first section having a first radius and at least one second section having a gradually increasing second radius, said second sections extending progressively into said first path during a predetermined stage of each revolution of said transfer members to thereby shift the adjacent articles of the file in said second direction, each of said transfer members including a foraminous wall defining a predetermined portion of the respective peripheral surface; drive means for rotating said transfer members in synchronism and in the same direction so that the second sections of said peripheral surfaces simultaneously engage longitudinally spaced-apart portions of successive foremost articles of the file in said first path while such articles continue to move in said first direction; and means for establishing a pressure differential at the opposite sides of said foraminous walls so that said predetermined portions of the peripheral surfaces attract the articles to the corresponding transfer members.

* * * * *